US005158492A

United States Patent [19]

Rudell et al.

[11] Patent Number: 5,158,492

[45] Date of Patent: Oct. 27, 1992

[54] LIGHT ACTIVATED DOLL

[75] Inventors: Elliot A. Rudell, 6556 Sattes Dr., Rancho Palo Verdes, Calif. 90274; Joseph S. Cernansky, Lomita; George T. Foster, Signal Hill; Richard P. Kamrath; Raymond E. Fisher, both of Lomita; Alan R. Pitkanen, Manhattan Beach, Calif.

[73] Assignee: Elliott A. Rudell, Torrance, Calif.

[21] Appl. No.: 686,229

[22] Filed: Apr. 15, 1991

[51] Int. Cl.[5] ..... A63H 13/00

[52] U.S. Cl. ..... 446/175; 446/354

[58] Field of Search ..... 446/175, 354, 355, 298, 446/300, 301, 356, 299; 40/414, 418

[56] References Cited

U.S. PATENT DOCUMENTS

| | | | |
|---|---|---|---|
| 3,274,729 | 9/1966 | Refabert | 446/175 |
| 3,731,426 | 5/1973 | Lewis et al. | 446/320 |
| 3,858,353 | 1/1975 | Glass et al. | 446/354 |
| 4,659,919 | 4/1987 | Price | 446/175 X |
| 4,675,519 | 6/1987 | Price | 446/175 X |
| 4,757,491 | 7/1988 | Koike | 446/175 X |
| 4,795,395 | 1/1989 | Oishi et al. | 446/175 |
| 4,815,733 | 3/1989 | Yokoi | 446/175 X |
| 4,840,602 | 6/1989 | Rose | 446/175 |
| 4,944,708 | 7/1990 | Kawabe | 446/175 |
| 5,013,276 | 5/1991 | Garfinkel | 446/175 X |

OTHER PUBLICATIONS

Big Jim, America's New Sports Action Hero, Mattel 1972. p. 26, advertisement.

Fashion Photo Barbie, Mattel 1978, advertisement.

Light Speeder Cars, Mattell 1989, pp. 137–138, advertisement.

Posin Picture Perfect, Wonderama Ent., Inc., four photographs.

*Primary Examiner*—Mickey Yu

*Attorney, Agent, or Firm*—Blakely, Sokoloff, Taylor & Zafman

[57] ABSTRACT

An automotive doll that is activated by light. The doll has at least two moving parts, preferably the head, arms and torso of a girl like figure. Within the torso of the doll is a motor that is connected to a plurality of gears and cams that are attached to the moving parts. The motor is preferably powered by batteries that are connected to a light sensor attached to the doll. The sensor switches on the motor when light is directed toward the sensor. When the motor is activated, the torso, arms and head all move relative to each other. The parts move through predetermined cycles, such that the head, arms and torso rotate back and forth between two positions. The drive mechanism is constructed and arranged so that each moving part rotates through a different cycle. Such an arrangement creates a doll that can move into an almost infinite variety of positions, greatly reducing the mechanical appearance of the toy.

24 Claims, 8 Drawing Sheets

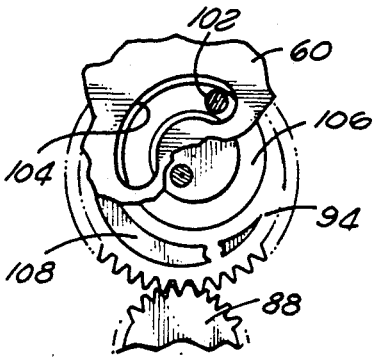
FIG. 6
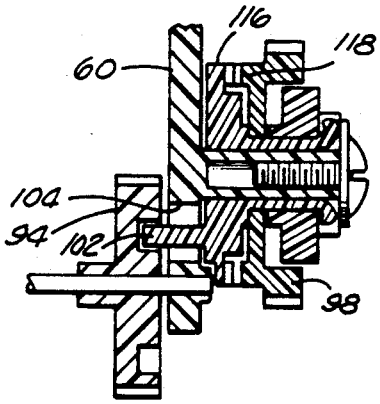
FIG. 7
FIG. 10
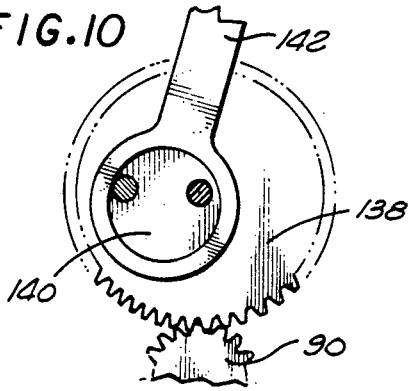
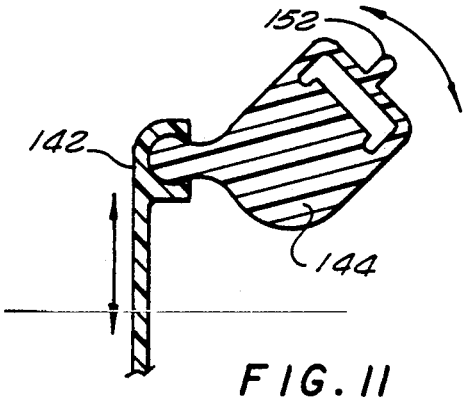
FIG. 11
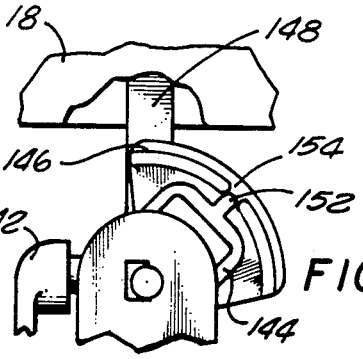
FIG. 12A
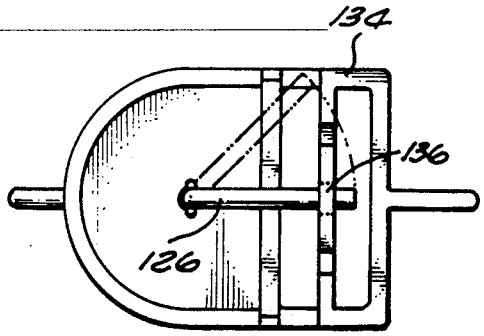
FIG. 9
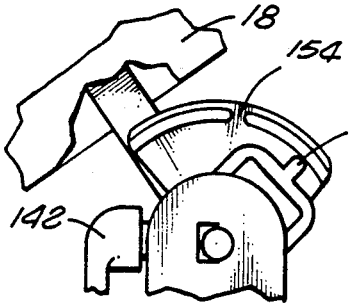
FIG. 12B

LIGHT ACTIVATED DOLL

BACKGROUND OF THE INVENTION

1. Field of the Invention

The invention relates to automotive toys, particularly a self propelled doll that can be remotely activated with a beam of light.

2. Description of Related Art

In an effort to make toys appear more life-like many products have been developed and marketed that allow a child to remotely control the movement of the toy.

One such doll included a toy sold by Mattel, Inc. under the tradename FASHION PHOTO BARBIE. This toy consisted of a Barbie doll that could be mounted on a pedestal, such that a child could twist and move the doll with a remote tethered wound spring cord, typically referred to as a Bowden cable. The doll was moved so that the child could take pictures of "Barbie" in different poses. Although the child could remotely move the doll, the motion of the doll was mechanical in appearance and limited to a few positions. The remoteness of the operator was limited by the length of the cord which had to be operated so that the movement of the doll had to be performed separately from the taking of the pictures.

Wonderama Enterprises, Inc. marketed a doll under the tradename POSIN PICTURE PERFECT which included a doll that is attached to the stand of a revolving pedestal. Within the pedestal is a light sensor connected to a motor, that would rotate the stand and doll when light was directed toward the sensor. The pedestal also had a power supply that would supply current to bimetallic springs located within the body of the doll. The springs are subsequently heated and cooled in accordance with the pattern of a Mylar disc that is inserted into the pedestal. The springs cause the arms and head of the doll to move as the doll is rotating around the pedestal. The pedestal is quite large and bulky, making the toy impractical to carry around as children so often do. To vary the movement of the doll, a new Mylar disc would have to be inserted into the pedestal. The replacement of the Mylar disc required a partial disassembly of the pedestal, which is time consuming and typically beyond the sophistication of many children. Additionally, the doll would have to be attached to the stand, which created a stiff mechanical like doll movement and appearance.

Mattel, Inc. sold another toy under the tradename BRAVE STARR. This toy had a spring-loaded arm, leg or accessory that would be released from the character by a spring when the figure, also attached to a base, received a light beam signal. Mattel, Inc. also marketed a line of small cars under the tradename LIGHT SPEEDERS, which raced around a track while the child shined a light beam on them.

U.S. Pat. No. 4,815,733 issued to Yokoi discloses as a robot that moves in accordance with the intensity of light, that is projected by a screen controlled by an operator through a joystick. The movement of the robot requires operation by the user, wherein any positioning of the toy must be induced by the operator.

U.S Pat. No. 3,274,729 issued to C. Refabert; U.S. Pat. No. 4,757,491 issued to Koike; U.S. Pat. No. 4,840,602 issued to Rose; and U.S. Pat. Nos. 4,659,919 and 4,675,519 issued to Price all disclose a doll that emits sound when a beam of light is directed toward the doll.

What is desired is an automotive doll that can be activated by a beam of light so that various parts of the doll move relative to each other. It is also desirable to have such a doll that can move without the attachment or operation of another device by the user, and to have motion that is random and human like in appearance.

SUMMARY OF THE INVENTION

The present invention is an automotive doll that is activated by light. The doll has at least two moving parts, preferably the head, arms and torso of a girl like figure. Within the torso of the doll is a motor that is connected to a plurality of gears and cams that are attached to the moving parts. The motor is preferably powered by batteries that are connected to a light sensor attached to the body of the doll. The sensor switches on the motor when light is directed toward the sensor. What is thus disclosed is an automotive doll that moves when activated by a remote source of light.

The various parts of the doll move through predetermined cycles, such that the head, arms and torso rotate back and forth between two positions. The drive mechanism is constructed and arranged so that each moving part rotates through a different cycle. Such an arrangement creates a doll that can move into an almost infinite variety of positions, greatly reducing the mechanical appearance of the toy.

The doll may also have a plurality of clutch mechanisms that allow a child to move the limbs and body of the doll without damaging the gears and motor mechanism. The motor, gears, cams and batteries are all contained by the shell of the doll, so that a child may pick up the toy and play with the same without operating the drive mechanism.

Therefore it is an object of this invention to provide a light activated automotive doll that houses the power supply, light sensor and drive mechanism within the body of the doll.

It is also an object of this invention to provide a doll with moving parts that rotate relative to each other in a seemingly random manner so that the doll has a more human like motion.

It is also an object of this invention to provide a light activated automotive doll that can be picked up and played with without utilizing the drive mechanism of the doll.

BRIEF DESCRIPTION OF THE DRAWINGS

The objects and advantages of the present invention will become more readily apparent to those skilled in the art after reviewing the following detailed description and accompanying drawings, wherein:

FIG. 6 is a cross-sectional view taken at line 6—6 of FIG. 4;

FIG. 7 is a cross-sectional view taken at line 7—7 of FIG. 4;

FIG. 9 is a cross-sectional view taken at line 9—9 of FIG. 8;

FIG. 10 is a cross-sectional view taken at line 10—10 of FIG. 4;

FIG. 11 is a cross-sectional view taken at line 11—11 of FIG. 8;

FIG. 12A is a side view taken at line 12—12 of FIG. 8 showing the clutch mechanism of the head engaged;

FIG. 12B is a side view similar to FIG. 12A showing the clutch mechanism disengaged;

DETAILED DESCRIPTION OF THE INVENTION

Figure 1:
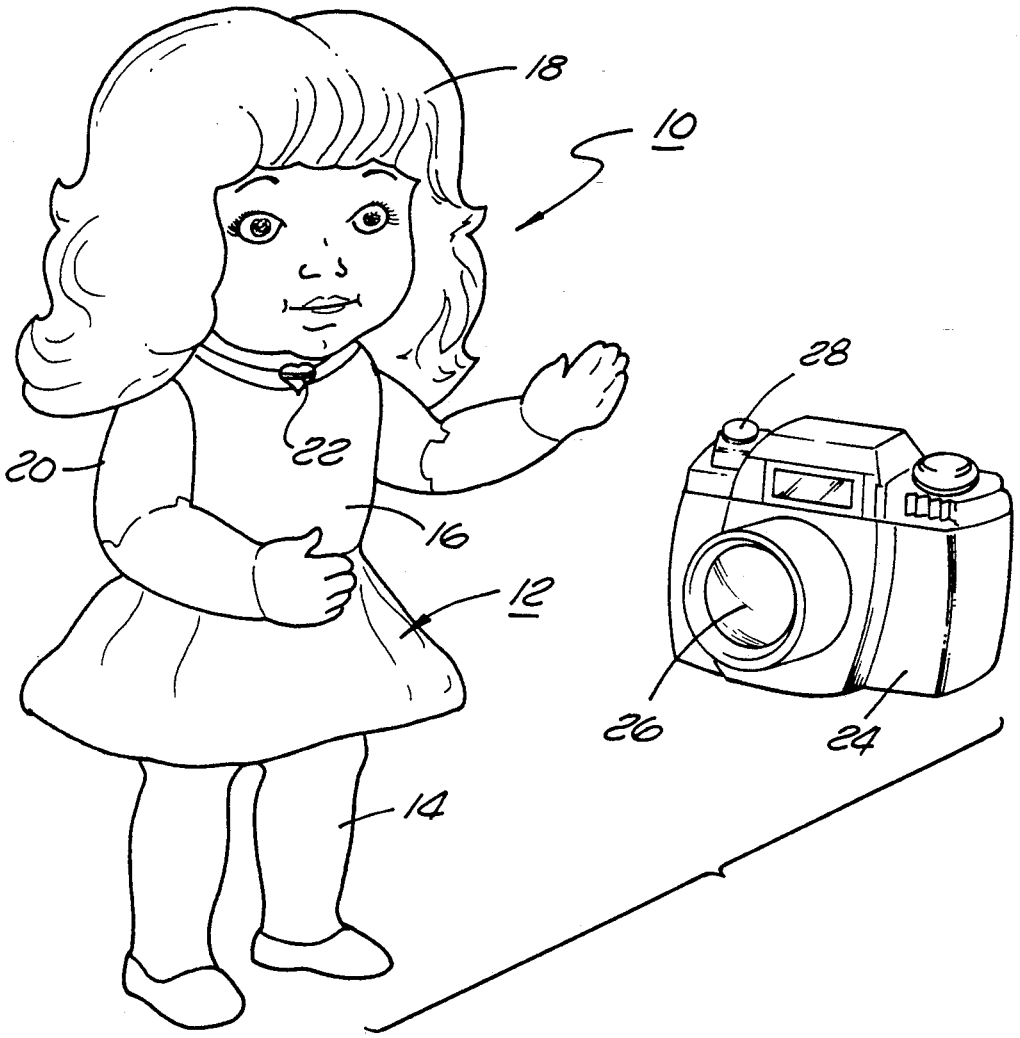
FIG. 1 is a perspective view of a doll of the present invention.

Referring to the drawings more particularly by reference numbers, FIG. 1 is a doll 10 of the present invention. In the preferred embodiment the doll 10 has a shell 12 shaped in the image of a young girl. The doll 10 has a pair of legs 14 that are preferably stationary and spread apart so that the toy 10 can be easily balanced in an upright position. The doll 10 further has a torso 16 pivotally attached to the legs 14 to swivel about the same. Pivotally attached to the torso 16 are the head 18 and arms 20 of the doll 10, that move in a manner approximating human motion. Housed within a heart shaped pendent is a light sensor 22 that is sensitive to light. The light sensor 22 is connected to a drive mechanism within the doll 10, that moves the torso 16, arms 20 and head 18 when light is directed toward the sensor 22.

Figure 2:
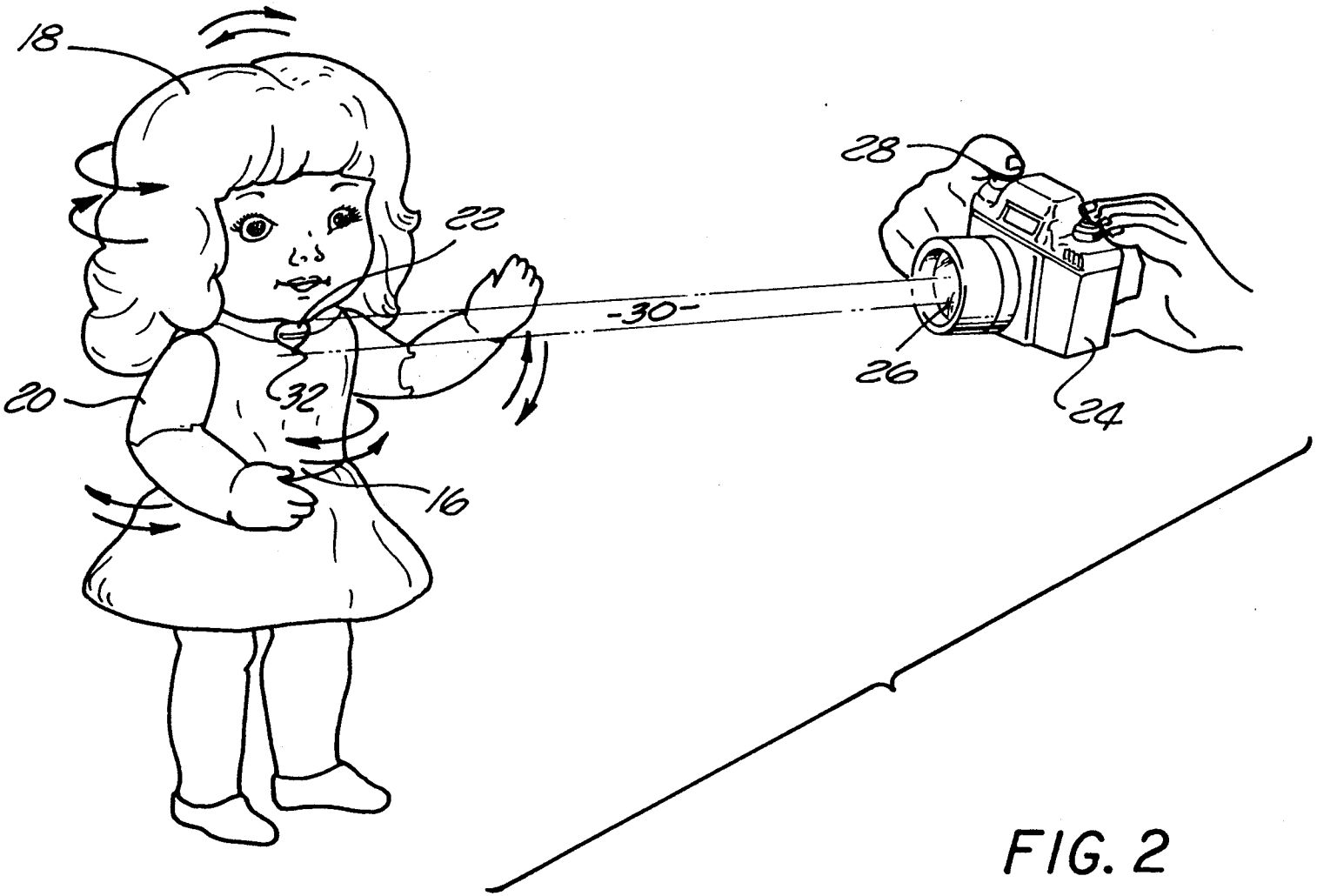
FIG. 2 is a perspective view of the doll of FIG. 1 that has been activated by a light, such that the torso, arms and head of the doll move in the directions indicated by the arrows.

The toy 10 may have a camera shaped plastic housing 24 that contains a light bulb 26 and a switch 28. As shown in FIG. 2, when the switch 28 is pressed down light 30 is emitted by the light bulb 26. The camera 24 is preferably being constructed to have batteries (not shown) that power the light bulb 26. The user of the toy 10 may direct the light 30 of the camera 24 toward the light sensor 22, wherein the light beam 30 activates the doll 10 to move in the directions indicated by the arrows in FIG. 2. The light sensor 22 deactivates when light 30 is not directed toward it. The light sensor 22 preferably has a slit 32 that only allows collimated light to activate the doll 10. In this manner the doll 10 only moves when a light beam 30 is shown directly on the sensor 22, so that the doll 10 does not move when exposed to ordinary room light.

Figure 3:
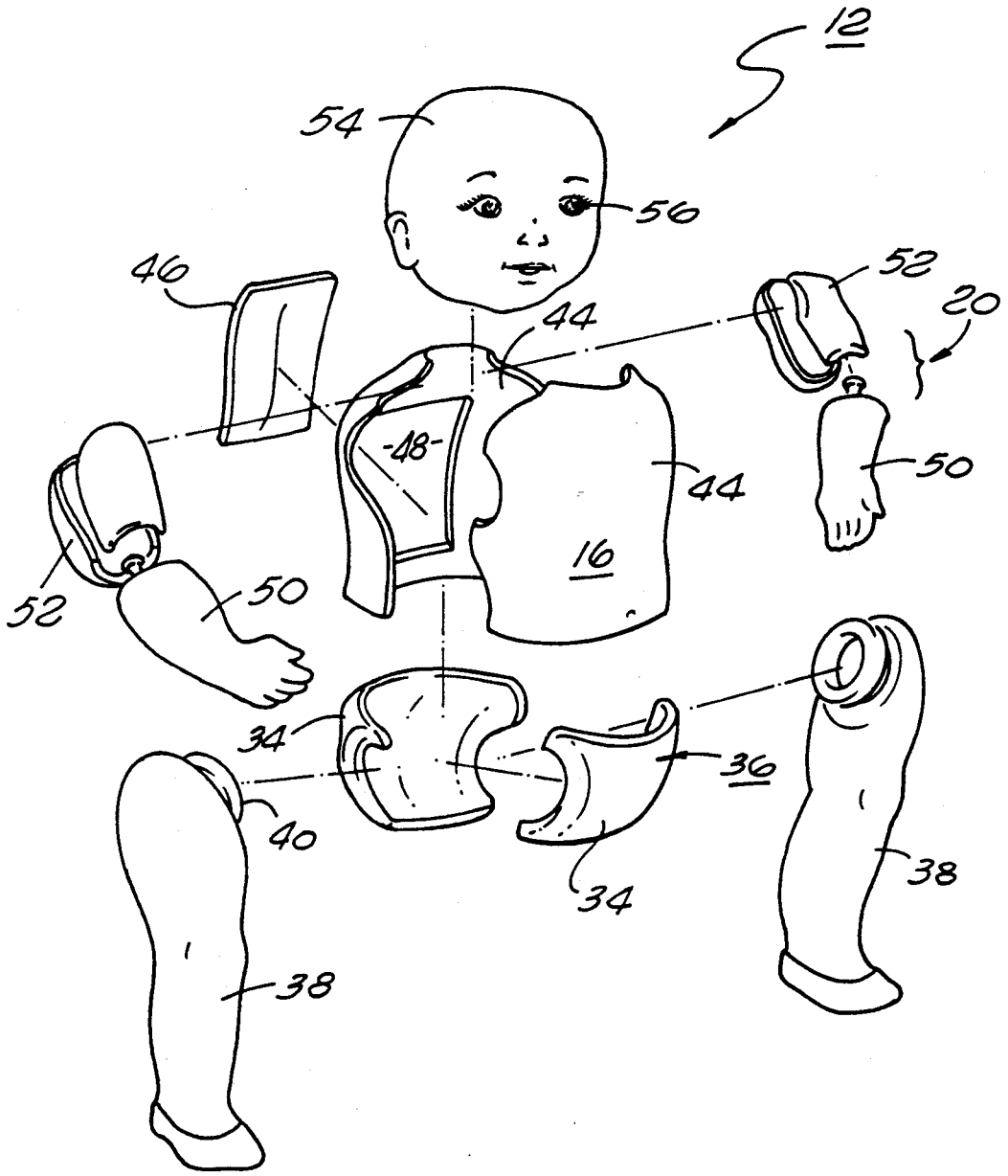
FIG. 3 is an exploded view of the doll of FIG. 1 showing the various parts of the shell of the doll.

FIG. 3 shows a preferred embodiment of the various parts of the shell 12. The doll has two mating lower sections 34 that combine to define the abdomen 36 of the girl. Attached to the abdomen 36 are a pair of legs 38 that have bearing sections 40 which fit within holes formed in the lower sections 34. Located above the abdomen 36 are two upper sections 44 that combine to define the girl's torso 16. The torso 16 has a detachable plate 46 that provides access to a battery compartment 48, which allows the insertion of batteries into the doll 10. Attached to the torso 16 is a pair of arms 20. Each arm 20 has a forearm section 50 which is connected to mating upper arm sections 52 as shown in FIG. 3. The legs 38, abdomen 36, torso 16 and arms 20 are preferably molded from a hard plastic such as a high impact polystyrene, to increase the rigidity of the doll 10. As an alternative, the limbs may be molded from a vinyl plastisol for a more life like feel. Also attached to the torso is a head 54. The head 54 is preferably molded from a soft plastic or rubber, so that it is not damaged if the doll 10 is dropped by the user. The eyes 56 may have embedded crystalline stones that reflect light, such that the doll 10 creates a "twinkle" in her eye when the camera 24 emits a beam of light toward the doll 10.

Figure 4:
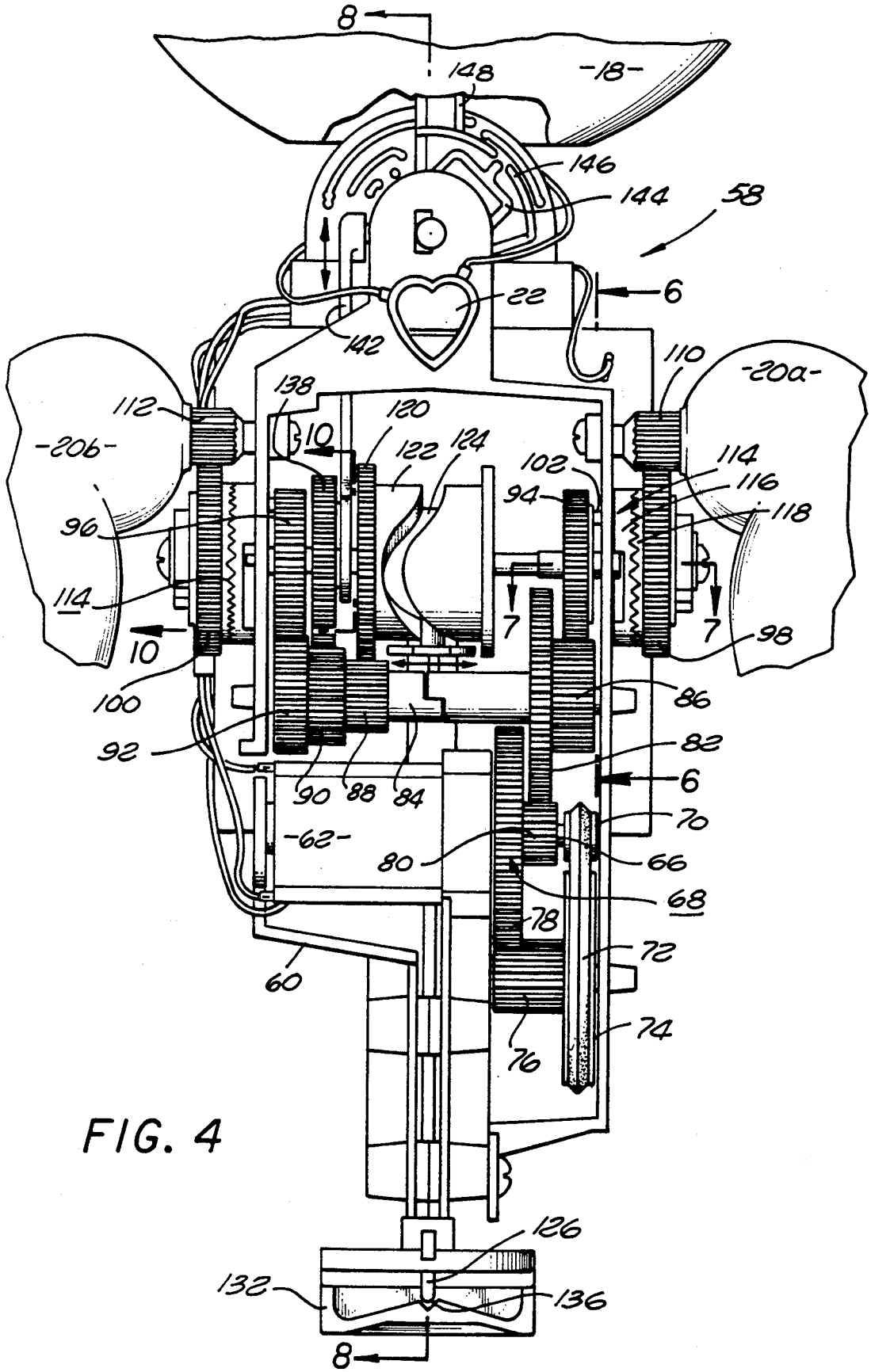
FIG. 4 is a sectional front view of the doll showing the drive mechanism of the doll.
Figure 5:
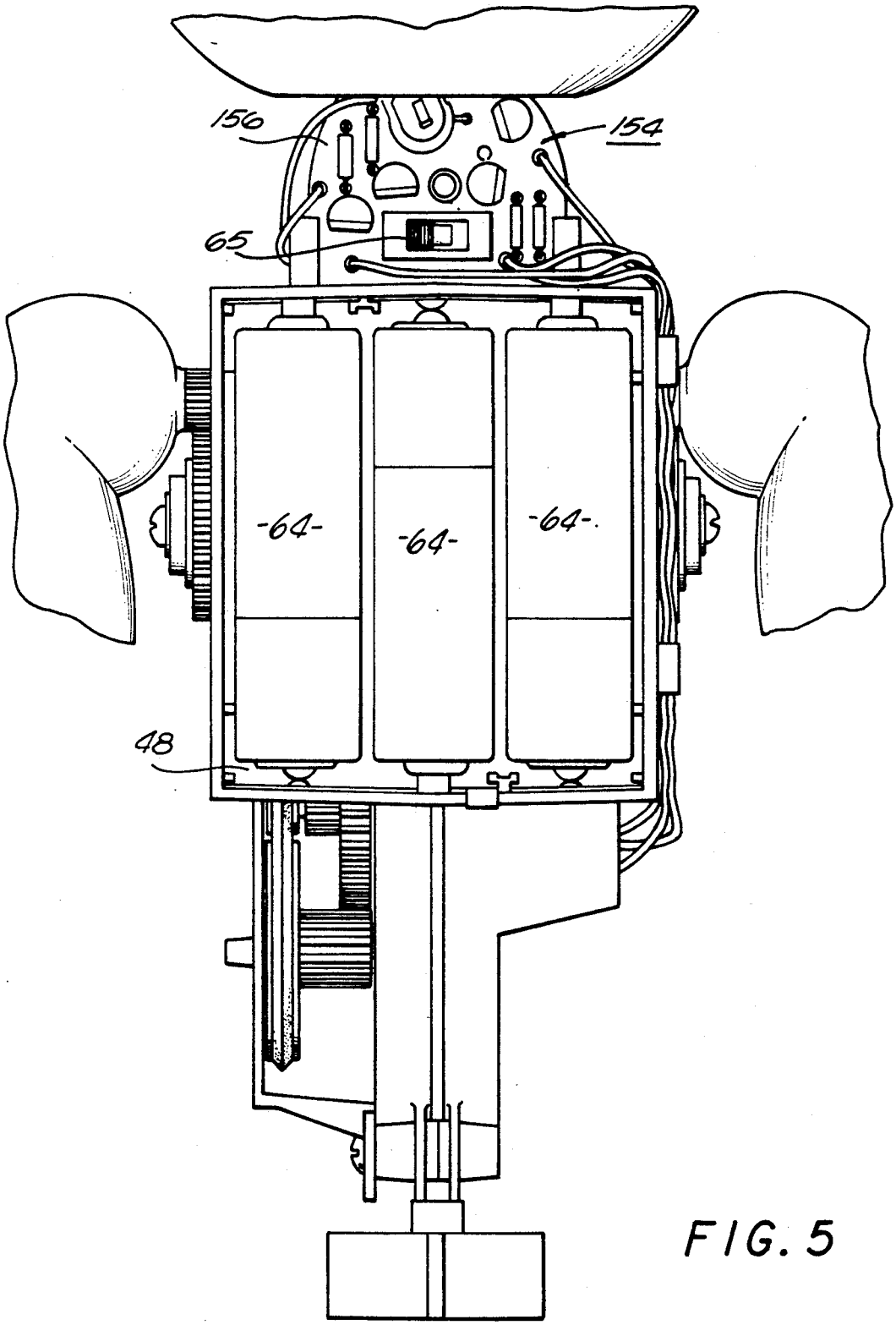
FIG. 5 is a sectional back view of the doll showing batteries installed within a battery compartment.

FIG. 4 shows a preferred embodiment of the drive mechanism 58 of the present invention. The drive mechanism 58 is completely contained by the torso 16 of the girl, so that a child may pick up the doll 10 and play with it, without having to unplug or disconnect the toy from another device. Within the torso 16 is a frame 60 preferably molded from hard plastic. Attached to the frame 60 is an electric motor 62 that is wired to batteries 64 inserted into the battery compartment 48 of the doll 10, as more clearly shown in FIG. 5. Between the motor 62 and batteries 64 is a mechanical switch 65 that allows the user to deactivate the drive mechanism 58. The batteries 64 and motor 62 are in series with the light sensor 22 which acts as another switch. When light 30 is detected by the sensor 22, the sensor 22 closes the circuit between the motor 62 and batteries 64, allowing current to flow to the motor 62 and activating the same. The motor 62 has an output shaft 66 attached to a first pulley 70. Attached to the first pulley 70 is a belt 72 that couples the first pulley 70 to a second pulley 74. Connected to the second pulley 74 is gear 76 that meshes with a first gear face 78 of gear 68. Gear 68 also has a second gear face 80 that drives gear 82 that is connected to a first shaft 84. Gear 82 has a larger diameter than the second gear face 80, so that the first shaft 84 rotates slower than the output shaft 66 of the motor. This gear reduction allows the use of high speed commercially available electric motors 62.

Also attached to the first shaft are gears 86, 88, 90 and 92. Gears 86 and 92 are coupled to and drive gears 94 and 96, respectively. Gears 98 and 100 are connected to gears 94 and 96 by pins 102, that extend through slots 104 in the frame 60 and travel within grooves 106 located in the gear housings as more clearly shown in FIG. 6. The grooves 106 follow elliptical cams 108 formed within gears 94 and 96. Rotation of the gears 94 and 96 move the pins 102 between the two outer edges of the slots 104 in an oscillating manner, rotating the gears 98 and 100 back and forth. Gears 98 and 100 are coupled to gears 110 and 112, which are attached to the first 20*a* and second arms 20*b* of the doll 10, respectively. The oscillating movement of the gears 98 and 100 cause the arms 20 to move between two points, typically in an up and down fashion.

Gear 96 has a larger diameter than gear 94 such that the first arm 20*a* moves faster than the second arm 20*b*. The different gear ratios cause the first arm 20*a* to go through a complete cycle of motion in less time than the second arm 20*b*, so that the rotation, of arms is out of phase. This nonsynchroneous arm rotation creates random arm movement that produces a doll 10 with more human like motion. Gears 98 and 100 also have slip clutches 114 that allow the user to move the arms independently from the drive mechanism 58. The clutches 114 each have a first 116 and second plate 118 attached to the pins 102 and gears (98 and 100), respectively, as more clearly shown in FIG. 7. The plates have intermeshing teeth that lock the pins 102 and gears 98 and 100 together, such that movement of the pins 102 rotates the arms 20 accordingly. When the motor 62 is inoperative, the pins 102 and first plates 116 are fixed, wherein the arm 20 can be turned such that the teeth of the second plate 118 move relative to the teeth of the first plate 116, all ®wing the second plate 118 and gears 98 and 100 to rotate relative to gears 94 and 96. The clutches 114 allow the arms 20 to be manually moved without moving the rest of the drive mechanism 58, which could damage the attached gears and motor. Conversely the clutches 114 also allow operation of the motor 62 and rotation of gears 94 and 96, when the arm or arms are fixed in a stationary position. Such an event could occur if a child is holding the arms 20 when the sensor 22 is activated.

Figure 8:
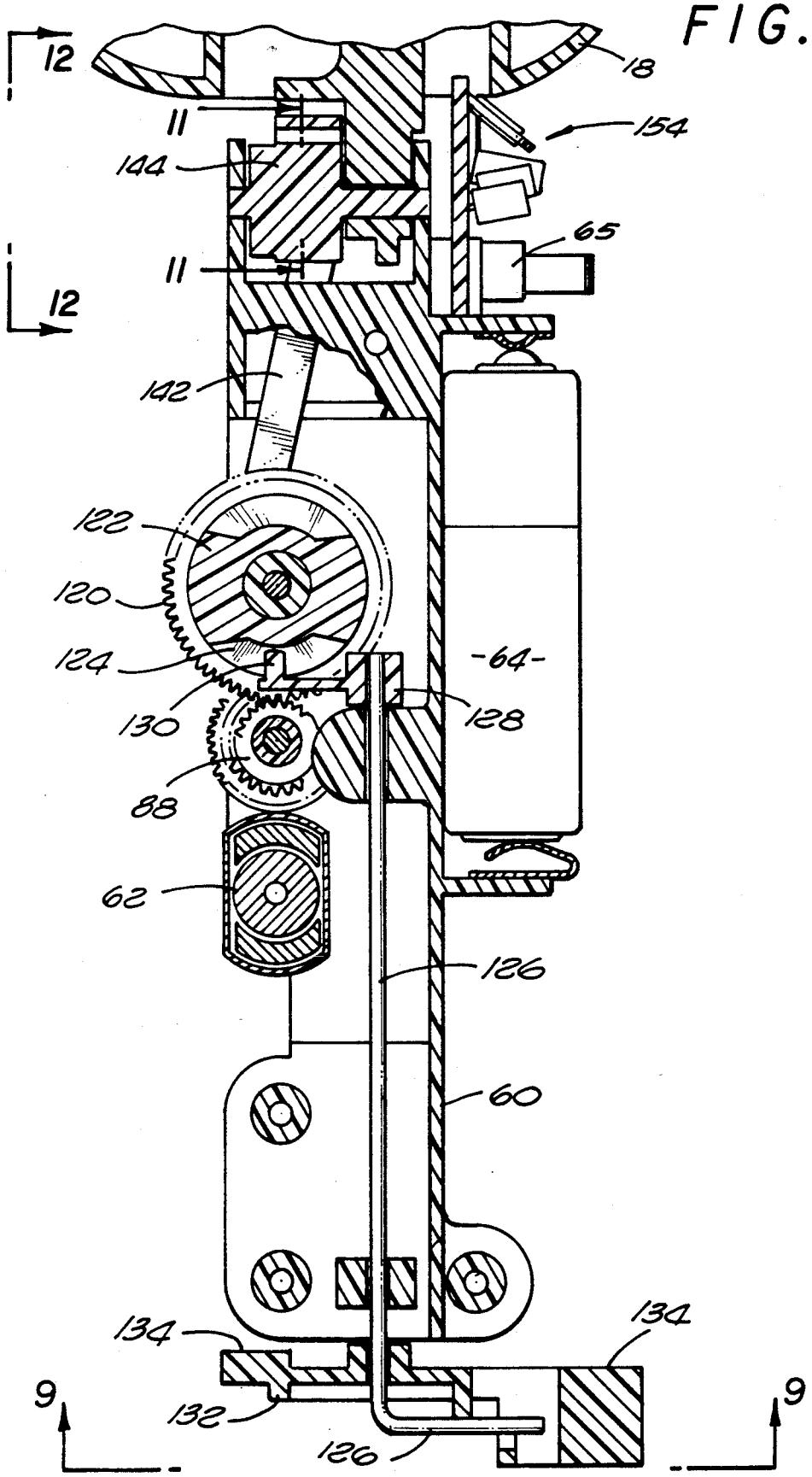
FIG. 8 is a cross-sectional view taken at line 8—8 of FIG. 4.

Gear 88 is coupled to gear 120 which is attached to a drum cam 122. The drum cam 122 has a slot 124 that extends around the circumference of the drum. As more clearly shown in FIG. 8, a second shaft 126 is coupled to the drum cam 122 through a first lever 128 that has a pin 130 which follows the slot 124 of the cam. The second shaft 126 is attached to member 132 that has a pair of wedges 134 which fit within slots (not shown) located in the shell 12 of the torso 16. When the drum cam 122 is rotated the slot 124 moves the pin 130 in the direction indicated by the arrow in FIG. 4. The pin 130 movement rotates the first lever 128 and second shaft 126. which in turn rotates the torso 16 back and forth between two positions. The diameter of gear 120 is larger than the diameters of gears 94 and 96, so that the drum cam 122 rotates slower than the elliptical cams 108. This causes the torso 16 to travel through a moving cycle in a greater amount of time than either of the arms 20*a* or 20*b*. In this manner the torso 16 and each arm 20 all move in a nonrepeatable fashion, wherein the arms 20 are rotating through a second motion cycle while the torso 16 is still moving through its first motion cycle. The end of the second shaft 126 fits within a groove 136 in the second lever 134, see FIG. 4. As more clearly shown in FIG. 9, the end of the shaft 126 is constructed to slide in and out of the groove 136, so that the second lever 134 and attached torso 16 can be moved independently of the second shaft 126 and drum cam 122. This arrangement allows a child to move the torso 16 of the doll 10 without damaging the drive mechanism 58. Conversely the motor 62 may rotate the drum cam 122 and second shaft 126 when the torso 16 is held in a fixed position.

Referring to FIG. 4, gear 90 is coupled to gear 138 to drive and rotate the same. As more clearly shown in FIGS. 10 and 11, gear 138 is connected an overcenter cam 140 that is attached to a crankshaft 142 which is pinned to a third lever 144. Rotation of the gear 138 causes the crankshaft 142 to move in a linear fashion in much the same manner that a crankshaft is moved within an automobile engine. The linear motion of the crankshaft 142 rotates the third lever 144 about a pin as indicated by the arrows in FIG. 11. The third lever 144 is coupled to a fourth lever 146, such that the fourth lever 146 rotates with the third lever 144. Attached to the fourth lever 146 is another shaft 148 that is attached to the head 18 of the doll. Rotation of the third 144 and fourth 146 levers by the crankshaft 142 causes the head 18 to pivot back and forth between two positions. The diameter of gear 138 is different from the diameter of gears 94, 96 and 120, so that gear 138 rotates at a different RPM than said gears. This causes the head 18 to move through a motion cycle in a different amount of time than the moving cycles of the torso 16 and both arms 20. The third 144 and fourth 146 levers are constructed so that pin 152 can slide out of groove 154 as more clearly shown in FIGS. 12A and 12B. This arrangement allows the head 18 to be moved independently of the drive mechanism 58.

What has thus been described is an automotive doll 10, that moves its torso 16, arms 20 and head 18 when a light beam 30 is directed toward the light sensor 22 of the toy. The drive mechanism 58 of the doll 10 is such that the moving parts each rotate through motion cycles that are different in length from each other, wherein the doll moves in a more random and human like motion. In one preferred use, the simulated camera 24 is pointed at the doll 10 and the switch 28 is pressed down so that the child believes that she is taking a picture of the doll 10. The light 30 from the light bulb 26 activates the drive mechanism 58 to move the head 18, arms 20 and torso 16 of the doll 10. The nonsynchroneous movement of the moving parts cause the doll 10 to "pose" in an infinite variety of positions. Because the beam of light 30 produced by the camera 24 is instantaneous, a timer 154 can be incorporated into the doll 10 to continue the movement of the moving parts for a predetermined amount of time (typically 1-2 seconds) after the light beam 30 has been terminated. The timer 154 can be constructed onto a circuit board 156 located within the torso 16 and connected to both the batteries 64 and motor 62. The incorporation of the drive mechanism 58 entirely within the torso 16 allows the child to pick up the toy and play with it, so that the doll is useful in the event the drive mechanism 58 becomes inoperative, or the child no longer wants to utilized the automotive function of the toy. The clutch mechanisms 112, 126 and 136, 152 and 154, allow the head 18, arms 20 and torso 16 to be moved when the drive mechanism is not working or not desired.

Figure 13:
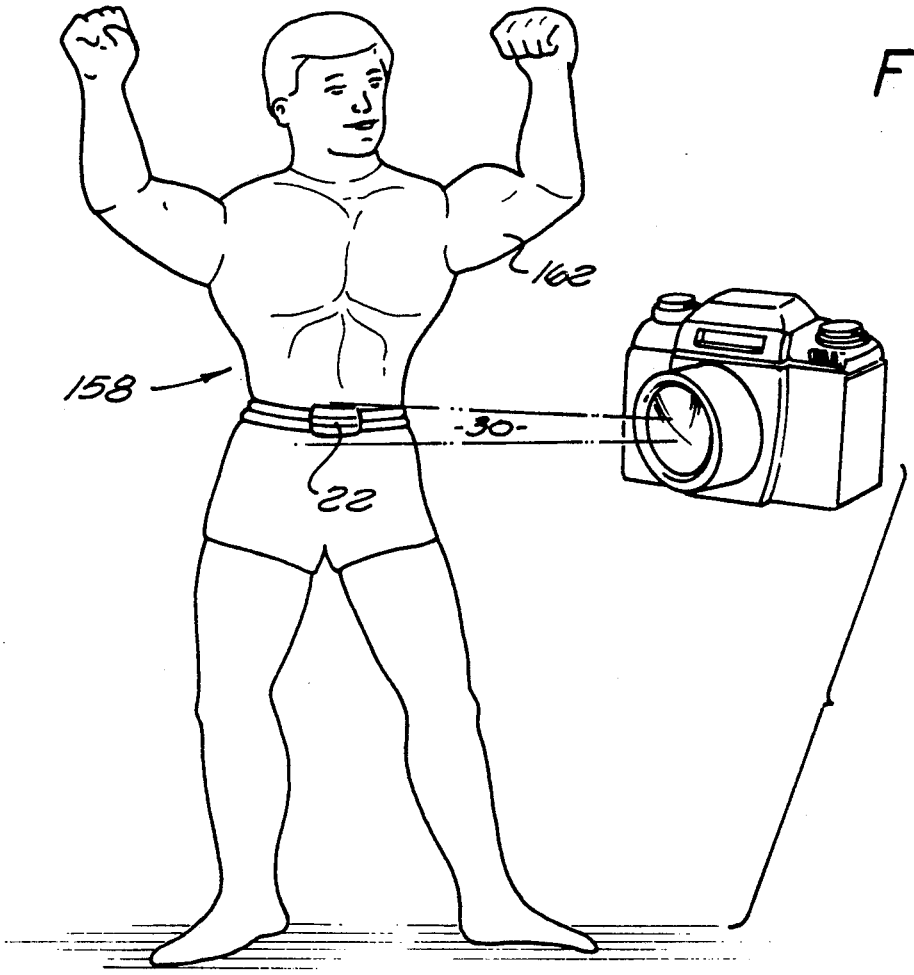
FIG. 13 is a perspective view of an alternate embodiment of the present invention.
Figure 14:
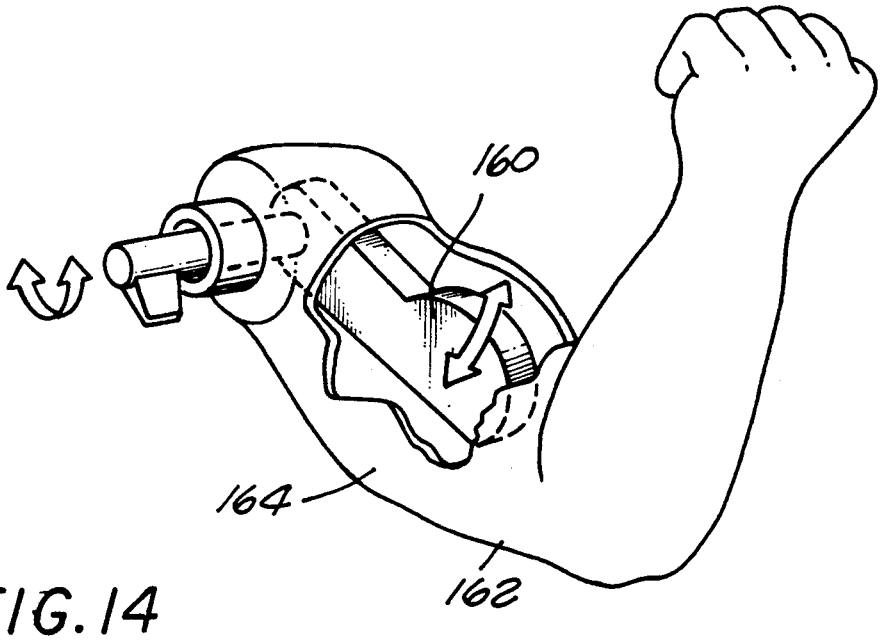
FIG. 14 is an enlarged sectional view of the arm portion of the toy of FIG. 13.

Although a girl like doll with moving arms, head and torso have been described, it is to be understood that the drive mechanism 58 can be used on other toys where it is desired to have moving parts that move through different cycles to create random movement. For example, the doll could be a plush covered animal that moves when activated by a beam of light. It is to be also understood that a light activated doll, animal, etc., may be constructed to have moving members that do not move through different motion cycles as described above. As another embodiment, the present invention can be incorporated into a different shaped human figurine, such as the male model 158 shown in FIG. 13. As shown in FIG. 14, the male model 158 may have a lever 160 in his arm 162 that rotates upward and stretches the skin 164, which is soft and flexible so that the arm 162 can stretch. The lever 160 is attached to gear 94, which oscillates the lever 160 between an extended and retracted position such that the male model 158 appears to be flexing his muscles. When the camera 24 is pointed toward the model and the light beam 30 is directed toward the light sensor 22, the male model 158 assumes an infinite amount of positions, simulating the movement of a body builder.

While certain exemplary embodiments have been described in detail and shown in the accompanying drawings, it is to be understood that such embodiments are merely illustrative of and not restrictive on the broad invention, and that this invention not be limited to the specific arrangements and constructions shown and described, since various other modifications may occur to those ordinarily skilled in the art.

What is claimed is:

1. An automotive doll, comprising:
a lower member;
a torso pivotally connected to said lower member;
a first arm pivotally connected to said torso;
a second arm pivotally connected to said torso;
a head pivotally connected to said torso; and,
drive means operatively connected to said lower member, said torso, said first arm, said second arm and said head for moving said torso, said arms and said head relative to each other, said drive means being constructed such that said torso, said arms and said head each move through a predetermined motion cycle, wherein said torso, said arms and said head each has a cycle time that is different from each other.

2. The doll as recited in claim 1, wherein said drive means includes a first gear operatively connected to said first arm, a second gear operatively connected to said second arm, a third gear operatively connected to said torso and a fourth gear operatively connected to said head, said first, second, third and fourth gears each having a different diameter such that said first arm, said second arm, said torso and said head each have a different cycle time.

3. The doll as recited in claim 2, wherein said drive means includes a pair of elliptical cams operatively connected to said arms and said first and second gears, said elliptical cams being constructed to rotate said arms between two positions.

4. The doll as recited in claim 2, wherein said drive means includes a drum cam operatively connected to said torso and said third gear, said drum cam being constructed to rotate said torso between two positions.

5. The doll as recited in claim 2, wherein said drive means includes an overhead cam operatively connected to said head and said fourth gear, said overhead cam being constructed to move said head between two positions.

6. The doll as recited in claim 3, wherein said drive means includes a drum cam operatively connected to said torso and said third gear such that said drum cam rotates said torso between two positions, said head and said fourth gear being operatively connected to an overhead cam such that said overhead cam moves said head between two positions.

7. The doll as recited in claim 6, wherein said drive means includes a motor operatively connected to said first, second, third, and fourth gears to drive said gears and move said arms, head and torso, said motor being connected to a power supply and a light sensor such that said light sensor switches power to said motor when light is directed toward said light sensor, whereby said arms, head and torso move when light is directed toward said light sensor.

8. The doll as recited in claim 7, wherein said drive means includes clutch means operatively connected to said gears and said arms, head and torso, such that said clutch means can disengage said arms, head and torso from said drive means whereby said arms, head and torso can be moved by a user.

9. A light activated automotive doll, comprising:
a shell having a stationary lower member, a torso pivotally connected to said lower member, a first arm pivotally connected to said torso, a second arm pivotally connected to said torso and a head pivotally connected to said torso;
a drive assembly that includes a first gear operatively connected to said first arm, a second gear operatively connected to said second arm, a third gear operatively connected to said torso and a fourth gear operatively connected to said head such that said arms, head and torso each move through a predetermined motion cycle, said first, second, third and fourth gears each having a different diameter such that said first arm, said second arm, said torso and said head each have a different cycle time;
a motor housed within said shell and operatively connected to said drive assembly such that said motor can move said torso, arms and head;
a power supply housed within said shell and operatively connected to said motor such that said power supply can supply power to said motor; and,
light sensing means attached to said shell and operatively connected to said power supply and said motor for switching power to said motor when light is directed toward said light sensing means;
whereby said torso, arms and head can move when light is directed to said light sensing means.

10. The doll as recited in claim 9, wherein said drive means includes a pair of elliptical cams operatively connected to said arms and said first and second gear, said elliptical cams being constructed to rotate said arms between two positions.

11. The doll as recited in claim 9, wherein said drive means includes a drum cam operatively connected to said torso and said third gear, said drum cam being constructed to rotate said torso between two positions.

12. The doll as recited in claim 9, wherein said drive means includes an overhead cam operatively connected to said head and said fourth gear, said overhead cam being constructed to move said head between two positions.

13. The doll as recited in claim 10, wherein said drive means includes a drum cam operatively connected to said torso and said third gear such that said drum cam rotates said torso between two positions, said head and said fourth gear being operatively connected to an overhead cam such that said overhead cam moves said head between two positions.

14. The doll as recited in claim 13, wherein said drive means includes clutch means operatively connected to said gears and said arms, head and torso, such that said clutch means can disengage said arms, head and torso from said movement means, whereby said arms, head and torso can be moved by a user.

15. The doll as recited in claim 9, wherein said light sensing means includes a timer operatively connected to said motor and said power supply, said timer being constructed to allow said power supply to power said motor for a predetermined amount of time after light is no longer directed to said light sensing means.

16. The doll as recited in claim 9, wherein said light sensing means is constructed to switch power to said motor only when collimated light is directed toward said light sensing means.

17. The doll as recited in claim 9, further comprising a camera shaped housing that contains a light bulb connected to a switch such that said light bulb emits light when said switch is pressed down, whereby said camera shaped housing can be moved to face the doll and said switch can be pressed down such that light is directed toward said light sensing means moving the doll while light is directed toward said light sensing means.

18. The doll as recited in claim 9, further comprising means within said first arm for expanding said first arm when said first arm is moved in a first direction and retracting said first arm when said first arm is moved in a second opposite direction.

19. The doll as recited in claim 9, wherein said shell is constructed to resemble a small child.

20. The doll as recited in claim 9, wherein said shell is constructed to resemble an animal.

21. A light activated automotive doll, comprising:

a shell constructed to resemble a small child, said shell having stationary legs, a torso pivotally connected to said legs, a first arm pivotally connected to said torso, a second arm pivotally connected to said torso and a head pivotally connected to said torso;

a first gear and a first elliptical cam housed within said shell and operatively connected to said first arm to rotate said first arm relative to said torso;

a first clutch operatively connected to said first elliptical cam and said first arm that can disengage said first arm from said first elliptical cam and said first gear;

a second gear and a second elliptical cam housed within said shell and operatively connected to said second arm to rotate said second arm relative to said torso;

a second clutch operatively connected to said second elliptical cam and said second arm that can disengage said second arm from said second elliptical cam and said second gear;

a drum cam and a third gear housed within said shell and operatively connected to said torso to rotate said torso relative to said stationary legs;

a third clutch operatively connected to said drum cam and said torso that can disengage said torso from said drum cam and said third gear;

an overhead cam and a fourth gear housed within said shell and operatively connected to said head to move said head relative to said torso;

a fourth clutch operatively connected to said overhead cam and said head that can disengage said head from said overhead cam and said fourth gear;

a motor housed within said shell and operatively connected to said cams and said gears such that said motor can move said arms, head and torso;

a power supply housed within said shell and operatively connected to said motor such that said power supply supplies power to said motor to move said arms, head and torso;

a light sensor attached to said shell and operatively connected to said power supply and said motor that switches power to said motor when collimated light is directed toward said light sensor; and, a timer operatively connected to said motor and said power supply, said timer being constructed to allow said power supply to power said motor for a predetermined amount of time after said collimated light is no longer directed to said light sensor.

22. The doll as recited in claim 21, further comprising a camera shaped housing that contains a light bulb connected to a switch such that said light bulb emits light when said switch is pressed down, whereby said camera shaped housing can be moved to face the doll and said switch can be pressed down such that light is directed toward said light sensor moving the doll while light is directed toward said light sensor, wherein the doll moves for said predetermined amount of time after light is no longer directed toward said light sensor.

23. The doll as recited in claim 21, wherein said shell is constructed to resemble an adult male and said first arm further includes means within said first arm for expanding said arm when said first arm is rotated in a first direction and retracting said first arm when said first arm is rotated in a second opposite direction.

24. The doll as recited in claim 23, further comprising a camera shaped housing that contains a light bulb connected to a switch such that said light bulb emits light when said switch is pressed down, whereby said camera shaped housing can be moved to face the doll and said switch can be pressed down such that light is directed toward said light sensor moving the doll while light is directed toward said light sensing means, wherein the doll moves for said predetermined amount of time after light is no longer directed toward said light sensor.

* * * * *

UNITED STATES PATENT AND TRADEMARK OFFICE

CERTIFICATE OF CORRECTION

PATENT NO. : 5,158,492

DATED : October 27, 1992

INVENTOR(S) : Rudell et al.

It is certified that error appears in the above-identified patent and that said Letters Patent is hereby corrected as shown below:

In column 5, at line 4 change

"all ®wing" to -- allowing --

Signed and Sealed this

Eleventh Day of April, 1995

*Attest:*

*Attesting Officer*

BRUCE LEHMAN

*Commissioner of Patents and Trademarks*